US006178607B1

(12) United States Patent
Dischler

(10) Patent No.: US 6,178,607 B1
(45) Date of Patent: Jan. 30, 2001

(54) METHOD FOR TREATING A CREASE SENSITIVE FABRIC WEB

(75) Inventor: Louis Dischler, Spartanurg, SC (US)

(73) Assignee: Milliken & Company, Spartanburg, SC (US)

( * ) Notice: Under 35 U.S.C. 154(b), the term of this patent shall be extended for 0 days.

(21) Appl. No.: 08/593,670

(22) Filed: Jan. 29, 1996

(51) Int. Cl.[7] ..... D06C 29/00
(52) U.S. Cl. ..... 28/167; 26/1; 26/18.5
(58) Field of Search ..... 26/1, 18.5, 18.6, 26/19, 20, 21; 15/300.1, 301; 34/444, 447; 28/167

(56) References Cited

U.S. PATENT DOCUMENTS

| | | | |
|---|---|---|---|
| 300,964 | 6/1884 | Garnier . | |
| 392,082 | 10/1888 | Turner . | |
| 502,903 | 8/1893 | Fries . | |
| 2,730,786 | 1/1956 | Kindstrand et al. | 26/1 |
| 2,740,202 | 4/1956 | Fowle | 34/18 |
| 2,972,177 | 2/1961 | Bidgood, Jr. | 26/1 |
| 3,078,496 | 2/1963 | Doran et al. | 15/346 |
| 3,775,806 | 12/1973 | Olbrant et al. | 15/306 A |
| 3,925,865 | 12/1975 | Christian | 26/18.5 |
| 4,055,003 | 10/1977 | Sack | 34/155 |
| 4,286,395 * | 9/1981 | Hoesch | 34/444 |
| 4,345,385 * | 8/1982 | Sando et al. | 34/444 |
| 4,409,709 * | 10/1983 | Sando et al. | 28/155 |
| 4,575,952 | 3/1986 | Bodenan et al. | 34/54 |
| 4,837,902 | 6/1989 | Dischler | 26/1 |
| 4,918,795 | 4/1990 | Dischler | 26/1 |

FOREIGN PATENT DOCUMENTS

| | | | |
|---|---|---|---|
| 0012731 | 6/1980 | (EP) | F26B/13/20 |
| 662640 | 5/1979 | (SU) . | |
| 711210 | 1/1980 | (SU) . | |
| 595444 | 10/1981 | (SU) . | |
| 1252411 | 8/1986 | (SU) . | |

* cited by examiner

*Primary Examiner*—John J. Calvert
*Assistant Examiner*—Larry D. Worrell, Jr.
(74) *Attorney, Agent, or Firm*—Terry T. Moyer; William S. Parks

(57) ABSTRACT

A process for treatment of a web by means of impingement by high velocity gaseous fluid is provided. The process constitutes the provision of a web to a treatment zone at a tension of between about 1 and about 5 pounds force per linear inch of web width. In the treatment zone the web is subjected to the imposition of high velocity gaseous fluid substantially tangential to the web and in the direction of travel by the web through the treatment zone, such that a series of saw-tooth waves are formed in and move along the web in the direction of travel by the web. An apparatus for carrying out the process is also provided.

1 Claim, 1 Drawing Sheet

METHOD FOR TREATING A CREASE SENSITIVE FABRIC WEB

FIELD OF THE INVENTION

The present invention relates generally to a method for treating a web by directing a low pressure gas adjacent to and in the direction of web movement through a treatment zone and more particularly to a new and useful method for softening crease sensitive webs by the imposition of a low pressure gas at near sonic velocity between the material and a rigid plate whereby creasing is controlled through the supply of gas in the same direction as travel by the web.

BACKGROUND OF THE INVENTION

Materials such as fabrics are characterized by a wide variety of functional and aesthetic characteristics. Of those characteristics, a particularly important feature is fabric surface feel or "hand." The significance of a favorable hand in a fabric is described and explained in my U.S. Pat. Nos. 4,918,795 issued Apr. 24, 1990 and 4,837,902 issued Jun. 13, 1989 the teachings of which are both incorporated herein by reference.

My previous patents have identified techniques for conditioning textile sheets to change their aesthetic qualities. Specifically, these patents disclose methods and equipment for projecting low pressure, high velocity streams of gaseous fluid against a fabric web in a direction opposite and substantially tangential to the web of fabric, thereby creating saw-tooth waves having small bending radii which travel down the fabric thereby breaking up fiber-to-fiber bonds in the web so as to increase drape and flexibility.

It has been found that some crease-sensitive webs cannot be processed by the technique disclosed and taught in my previous patents without the formation of objectionable longitudinal creases. These creases occur as the web passes from a low tension region before contact with the stream of gaseous fluid to a high tension region after contact with such stream as the frictional interaction of the stream and the web increases the tension of the upstream web.

While the direction of flow of the stream in the previous method is substantially anti-parallel to the direction of travel of the fabric web, it is believed that small variations in flow direction result due to turbulence and discontinuous effects at the edge of the web. Such phenomena are believed to result in waves which have a component thereof which travels in the web direction substantially perpendicular to the direction of web travel which results in a slight narrowing of the web. As the web passes out of the stream of gaseous fluid, the waves are believed to collapse and the web width is substantially recovered, thereby resulting in small creases which may leave permanent marks in the web. This phenomena has been identified as being especially severe in very thin, tightly constructed fabric webs such as those used for computer dot matrix printer ribbons as well as in fabric laminates made up of one or more layers of fabric bonded by a film or adhesive layer or with a film sans fabric.

The common feature among those webs which exhibit undesirable creasing is the existence of relatively high in-plane compression stiffness and relatively low bending stiffness, which results in a reduced ability of the web to accommodate distortions and thereby promote the development of creases as described above. In addition, other materials may occasionally be sensitive to crease marks, especially when run with elevated gas temperatures.

It has been found that, by reversing the direction of web flow relative to the gaseous stream such that they travel in substantially the same direction, and by providing for a relatively low post treatment tension of the fabric web, creasing can be eliminated. This process is most efficient when the web velocity does not exceed approximately 10% of the velocity of the gaseous stream.

While the invention is illustrated and will be described in connection with potentially preferred embodiments, it is to be understood that there is no intention to limit the invention to such embodiments. On the contrary, it is intended to cover all alternatives, modifications and equivalents as may be included within the true spirit and scope of the invention.

DETAILED DESCRIPTION

Figure 1:
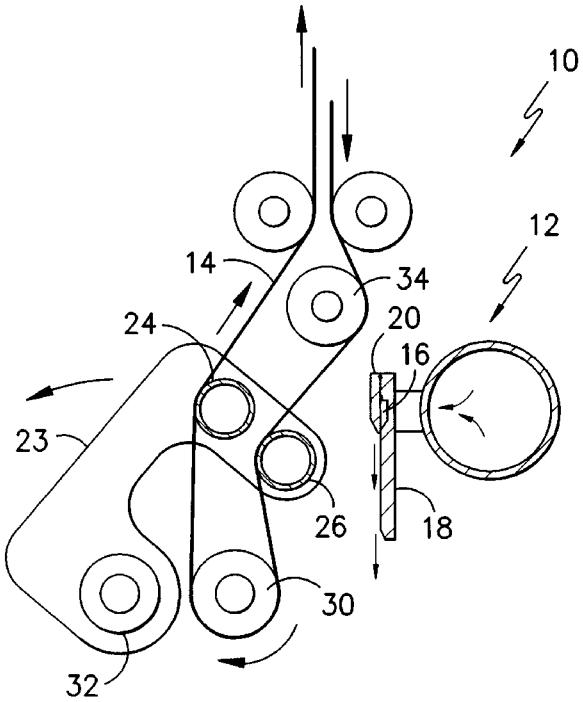
FIG. 1 is a cut-away side view of an apparatus for use in practice of the process of the present invention wherein the fabric web is removed from the treatment stream.
Figure 2:
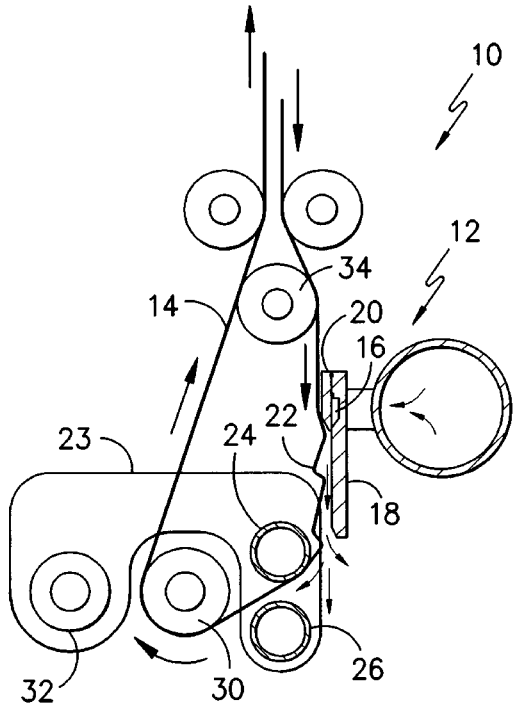
FIG. 2 is a view similar to FIG. 1, wherein the fabric web has been moved into contact with the treatment stream.

Turning now to the drawings, in FIGS. 1 and 2 an apparatus 10 is illustrated for carrying out the process of the present invention. In the illustrated configuration this apparatus includes a manifold 12 extending transverse to the direction of travel of a web 14. The manifold 12 supplies air or other gaseous fluid to a converging diverging jet 16 formed by a nozzle plate 18 and an upper nozzle plate 20. In the illustrated and potentially preferred practice of the present invention, a low pressure high velocity stream of gaseous fluid is directed between the web 14 and the nozzle plate 18 in the same direction as the travel of the web 14. This impingement by the gaseous fluid stream gives rise to the formation of saw-tooth waves 22 in a conditioning zone adjacent to the nozzle plate 18.

In the embodiment illustrated in FIGS. 1 and 2, the web 14 is brought into and out of contact with the gas treatment streams by means of a rotatable guide 23 including a first guide roll 24 and a second guide roll 26 through which the web 14 is threaded. As illustrated, the fabric web 14 travels around a scroll roll 30 which is used to adjust tension to open the web and to remove wrinkles. Further opening may be accomplished by scroll roll 34. The structure is preferably pivoted about the axis of shaft 32.

Figure 3:
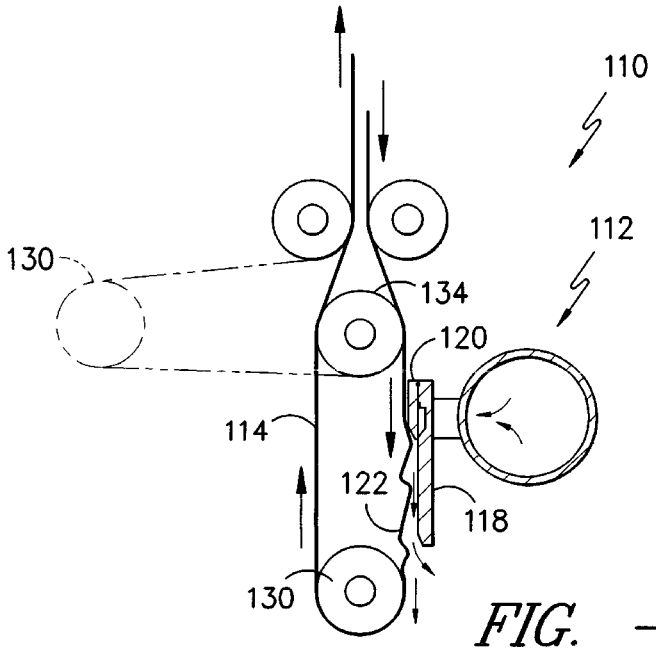
FIG. 3 is a cut-away schematic of another embodiment of the apparatus for use in practice of the present invention.

In the embodiment illustrated in FIG. 3, a plurality of saw-tooth waves 122 are produced in the web 114 by a plurality of gas streams formed by the nozzle plate 118 and the upper nozzle plate 120 which are supplied by manifold 112 substantially in the same manner as described above. In the embodiment shown in FIG. 3, the scroll roll 130 around which the web 114 is disposed is moveable along an arcuate path about the axis of scroll roll 134 between the treatment position as illustrated in solid lines and an inactive position as illustrated in broken lines thereby bringing the web into and out of contact with the gas treatment zone.

It is to be noted that while the process of the present invention is believed to be particularly useful in the treatment of textile fabrics, the practice is also believed to be applicable to materials other than traditional textile fabrics including polymeric films and other similar materials.

Those material webs which are sensitive to creasing when processed in the manner described in my U.S. Pat. Nos. 4,918,795 and 4,837,902 are believed to be characterized by relatively high in-plane compression stiffness in combination with relatively low bending stiffness as compared to materials which are generally treatable by such processes without creasing. The in-plane compression properties are, at the low forces under consideration for purposes of the present invention, generally mirror images of the tensile properties. Thus, it is believed that either high in-plane compression stiffness or high tensile stiffness may be used equivalently in most cases. Both the tensile and compression properties can be measured by the KAWABATA measurement system. In addition, the change in the bending properties during treatment has an affect on creasing when the web bending stiffness is lowered during processing. Thus, it is believed that in treating webs in the manner as described in my previous patents i.e. with the web movement being anti-parallel to the direction of the gaseous stream, the tendency to crease the web will increase as the through-put speed decreases. Other materials such as computer ribbon will crease at any speed when run against the gaseous stream, as the thin gauge of the fabric contributes to low bending stiffness and the tight construction of the fabric contributes to a high tensile stiffness.

Temperature and water content are also factors which affect web properties and therefore impact creasing. By way of example, fabrics constructed of water absorbent fibers are highly likely to exhibit creasing if operated under wet conditions because the large water absorption in the fibers results in swelling thereby producing a condition of very high in-plane compression stiffness. In a like manner, most fabrics containing polymeric fibers exhibit reduced bending stiffness when heated therefore promoting creasing when the web of such fabric is directed in opposition to a heated gaseous stream. In addition, this temperature effect is compounded by a greater tendency for the creases to be ironed into the fabric at higher temperatures.

Tensile stiffness as used herein is the stress divided by strain where the applied stress is 20 grams force/centimeter and the strain has units of centimeter/centimeter. The tensile stiffness thus is expressed in units of grams force-centimeter/centimeter$^2$ or grams force/centimeter. The bending stiffness used herein has the units of grams force-centimeter$^2$/centimeter or grams force-centimeter. The ratio of tensile stiffness to bending stiffness, therefore, is expressed in units of centimeter$^{-2}$. While these quantities have been expressed in particular metric units, it is to be understood and appreciated that such features can likewise be expressed in terms of English units or other equivalent systems and that no limitation is intended by selection of a particular system.

In evaluating web materials based on the above ratio, it is believed that creasing will generally begin to be encountered when the web is run in opposition to the gaseous stream, if the ratio of tensile stiffness to bending stiffness of the treated material is greater than approximately 0. 5 centimeter$^{-2}$ and becomes particularly problematic when such ratio is greater than approximately 2 centimeters$^{-2}$.

It is believed that a further advantage of the present invention results from the fact that a reduction of wash shrinkage results in textile fabrics treated by the process because the tension through the treatment zone continuously decreases thereby reaching a minimum as the web leaves the treatment area and is removed from contact with the gaseous stream. That is, when a fabric web and the gaseous stream are run in the same direction, the yarn structure within the fabric web is subjected to extreme agitation at lower and lower tensile stresses as it moves through the treatment zone thereby resulting in a relaxation of the overall structure. In the potentially preferred practice of the present invention, the web will enter the treatment zone at a tension of between about 1 and about 5 pounds force per linear inch of web width. Relaxation is believed to be particularly significant when wet textile fabric is dried by the application of a hot gaseous stream in which wash shrinkage may be substantially eliminated as shown in Table 1 below for a polyester/cotton woven uniform fabric.

TABLE 1

| | | 3rd Wash Shrinkage (%) | |
|---|---|---|---|
| | | Warp | Fill |
| Sample 1 | Untreated | 8.1 | (0.3) |
| | Wet Treatment | 1.3 | 0.3 |
| Sample 2 | Untreated | 6.8 | (0.4) |
| | Wet Treatment | 0.5 | (0.4) |
| Sample 3 | Untreated | 8.1 | 0.0 |
| | Dry Treatment | 3.8 | 0.0 |

*Values shown parenthetically exhibit extension rather than shrinkage.

It is believed that such relaxation is also desirable in the treatment of fabrics containing little or no finish such as those fabrics intended for use in automotive air bags where the maximum relaxation of the fabrics structure is desirable to aid in the packing of the fabricated bag which may be accomplished either wet or dry. Previously, with fabric travel and gaseous streams in opposition, tensile stresses were locked in as the fabric abruptly left the air stream. Tension in the web after the treatment area should be kept as low as possible and should be less than about one-half the tension prior to the treatment zone but should be more than about one pound force to enable opening of the web.

In light of the above, it can be seen that the present invention provides a new and useful process for the treatment of materials which have heretofore been difficult to handle according to previous techniques. The present invention thereby provides a useful advancement over such previous technology.

While specific features of the invention have been described, it will be understood, of course, that the invention is not limited to any particular configuration or practice since modifications may well be made and other embodiments of the principals of the invention will no doubt occur to those skilled in the art to which the invention pertains. Therefore, it is contemplated by the appended claims to cover any such modifications as incorporate the features of the invention within the true meaning, spirit and scope of such claims.

What is claimed is:

1. A method for treating a crease sensitive web, comprising the steps of:

supplying a web to a treatment zone at a tension of between about 1 pound force per linear inch of web width and about 5 pounds force per linear inch of web width with the tension of the web subsequent to treatment by a gaseous fluid being no greater than approximately one-half of the tension at which the web is supplied to the treatment zone;

treating the web by projecting at least one high velocity stream of gaseous fluid against only one side of the web substantially tangential to the path of travel of the web and in the direction of travel of the web such that a series of saw-tooth waves are formed in and move along the web in the direction of travel of the web; and removing the web from said treatment zone.

* * * * *